US006921229B2

(12) United States Patent
Klyne

(10) Patent No.: US 6,921,229 B2
(45) Date of Patent: Jul. 26, 2005

(54) METHOD OF MAKING TEMPORARY ROADS FROM PLANT FIBRE

(75) Inventor: Albert Allen Klyne, Enoch (CA)

(73) Assignee: 980107 Alberta Ltd., Enoch (CA)

( * ) Notice: Subject to any disclaimer, the term of this patent is extended or adjusted under 35 U.S.C. 154(b) by 0 days.

(21) Appl. No.: 10/942,386

(22) Filed: Sep. 16, 2004

(65) Prior Publication Data

US 2005/0042028 A1 Feb. 24, 2005

(51) Int. Cl.[7] ..... E01C 7/00
(52) U.S. Cl. ..... 404/75
(58) Field of Search ..... 404/17, 71, 72, 404/75; 427/136

(56) References Cited

U.S. PATENT DOCUMENTS 5,163,776 A 11/1992 Pouyer
5,273,373 A 12/1993 Pouyer
5,730,549 A * 3/1998 Choudin et al. ..... 404/75
6,575,660 B1 6/2003 Davis et al.

FOREIGN PATENT DOCUMENTS

| | | |
|---|---|---|
| CA | 2 437 640 | * 4/2004 |
| JP | 4-347202 | * 12/1992 |
| JP | 2001-252913 | * 9/2001 |

* cited by examiner

*Primary Examiner*—Gary S. Hartmann
(74) *Attorney, Agent, or Firm*—Davis & Bujold, P.L.L.C.

(57) ABSTRACT

A method of making temporary roads out of plant fibre includes a first step of providing plant fibre of differing lengths. A second step involves spreading the plant fibre along an intended travel path. A third step involves compacting the plant fibre. It has been found that medium length elongate plant fibre, when present in sufficient quantity, serve to mesh together the short length plant fibre to form a cohesive ground cover mat.

2 Claims, 2 Drawing Sheets

METHOD OF MAKING TEMPORARY ROADS FROM PLANT FIBRE

FIELD OF THE INVENTION

The present invention relates to a method of making temporary roads from plant fibre.

BACKGROUND OF THE INVENTION

Temporary roads must be built whenever work must be performed in undeveloped areas. For example, when drilling oil and gas wells, roads must be built in order to allow trucks and equipment access to the well site.

There are frequently regulations associated with performing work in environmentally sensitive areas, which require the site to be returned to its original pristine condition when work is completed. Such site restoration can become quite expensive with gravel roads.

Experimental roads have been built using plant fibre. There are abundant sources of plant fibre available in the form of sawdust, shavings and wood chips from the forestry industry. The advantage of using plant fibre in the construction of temporary roads, is the relatively low cost of site restoration. The plant fibre used to build the temporary road can be scattered about the site. Once thoroughly scattered, there will be negligible visible traces of the former road and the scattered plant fibre will break down through natural processes of decomposition.

Unfortunately, the attempts to make temporary roads out of sawdust, shavings and wood chips have proven to be unsuccessful. The sawdust, shavings and wood chips tends to slide past each other. They do not bind or bridge and are unable to provide an adequate driving surface.

SUMMARY OF THE INVENTION

What is required is a method of making temporary roads from plant fibre.

According to the present invention there is provided a method of making temporary roads out of plant fibre. A first step involves providing plant fibre of differing lengths, including:

- at least 20% by volume of medium length elongate plant fibre of a length of not less than 2 inches and not more than 5 inches;
- not more than 10% by volume of long length elongate plant fibre of a length of greater than 5 inches; and
- a balance of short length plant fibre of a length of less than 2 inches.

A second step involves spreading the plant fibre along an intended travel path. A third step involves compacting the plant fibre with the medium length elongate plant fibre serving to mesh together the short length plant fibre to form a cohesive ground cover mat.

It has been found that short length plant fibre will not built an adequate road. However, if medium length elongate fibre is added in sufficient quantities, it has been found that the medium length elongate plant fibres serve to mesh together the short length plant fibre to form a cohesive ground cover mat which is an adequate road travel surface. It was thought that if medium length elongate plant fibre worked, that long length elongate plant fibre would work even better. It has been found that this is not the case. To the contrary, when long length elongate plant fibre is present in too great a volume, it prevents the desired meshing phenomenon from taking place.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred method of making a temporary road with plant fibre will now be described with reference to FIGS. 1 through 4.

Figure 2:
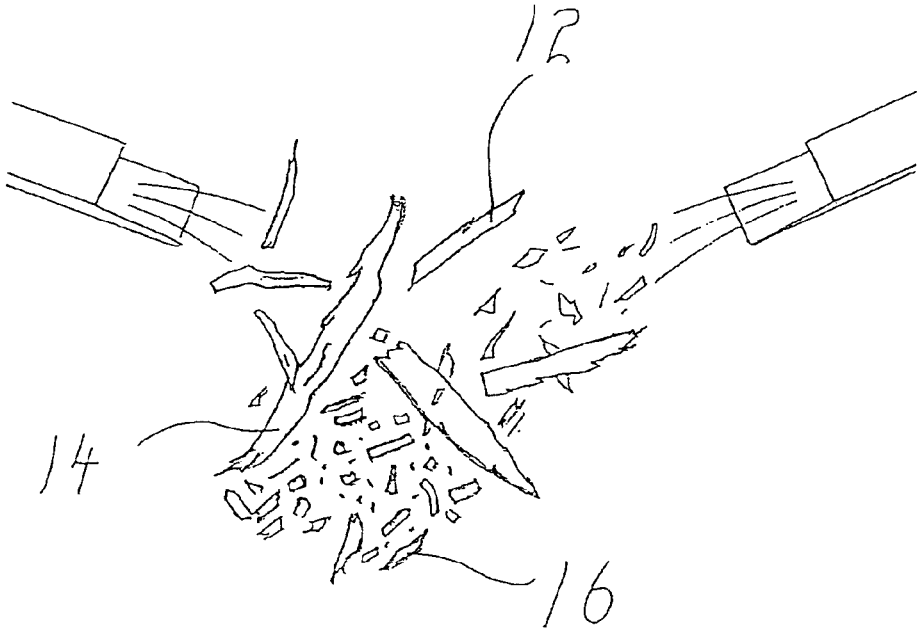
FIG. 2 is a perspective view of a first step of providing plant fibres of differing lengths.

Referring to FIG. 2, a first step involves providing plant fibre of differing lengths. There is at least 20% by volume of medium length elongate plant fibre 12 of a length of not less than 2 inches and not more than 5 inches. There is not more than 10% by volume of long length elongate plant fibre 14 of a length of greater than 5 inches. The balance is of short length plant fibre 16 of a length of less than 2 inches.

Figure 3:
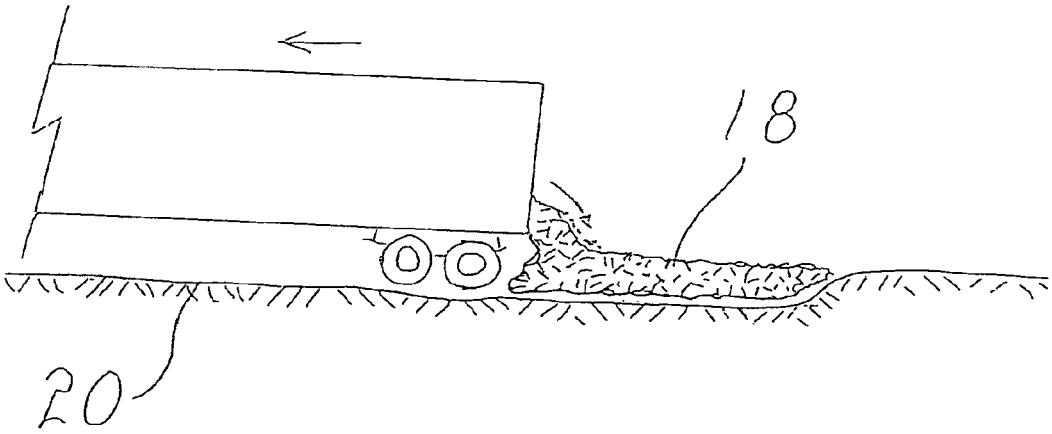
FIG. 3 is a side elevation view of a second step of spreading the plant fibre along an intended travel path.

Referring to FIG. 3, a second step involves spreading an appropriate mixture 18 of medium length elongate plant fibre 12, long length elongate plant fibre 14 plant fibres 12 and a balance of short length plant fibre 16 along an intended travel path 20.

Figure 1:
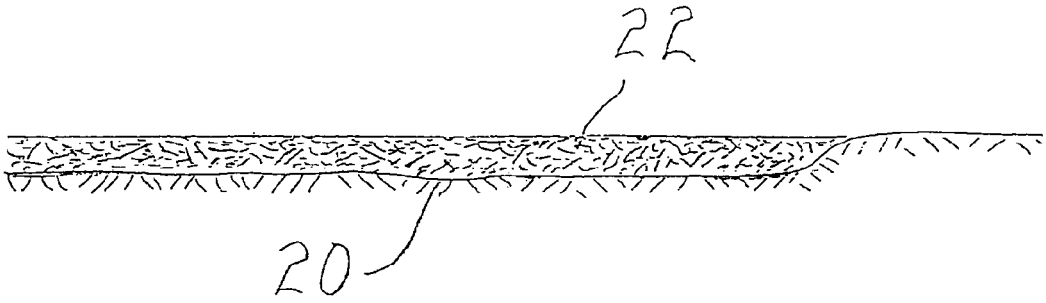
FIG. 1 is a side elevation view, in section, of a temporary road constructed in accordance with the teachings of the present method.
Figure 4:
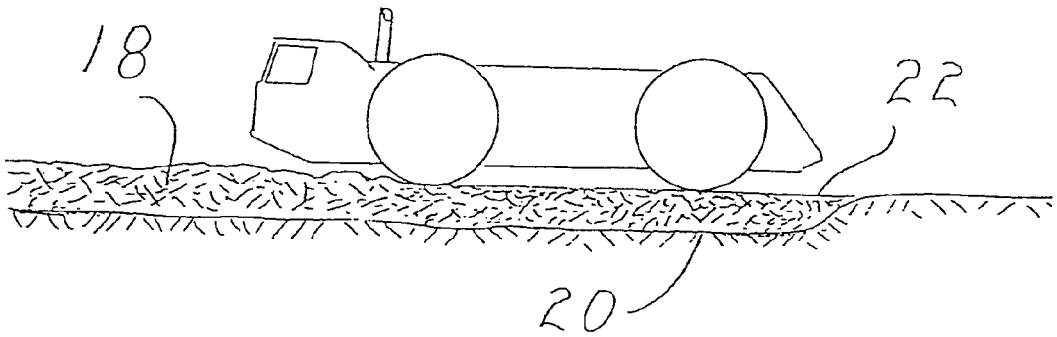
FIG. 4 is a side elevation view of a third step of compacting the plant fibre along the intended travel path.

Referring to FIG. 4, a third step involves compacting mixture 18. It has been found that that, when present in quantities of at least 20%, medium length elongate plant fibre 12 serves to mesh together short length plant fibre 16 to form a cohesive ground cover mat 22 as illustrated in FIG. 1. The short length plant fibre 16 is not suitable by itself. The compacting of mixture 18 can be accomplished by simply driving heavy equipment back and forth along the road.

In the illustrated embodiment, mixture 18 is of wood fibre. Although wood fibre is preferred, it will be appreciated that other comparable fibres may be used.

Cautionary Warnings:

It was thought that if medium length elongate plant fibre worked, that long length elongate plant fibre would work even better. It has been found that this is not the case. To the contrary, when long length elongate plant fibre is present in too great a volume, it prevents the desired meshing phenomenon from taking place. It would be undesirable to have more than 10% of long length elongate plant fibre.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of making temporary roads out of plant fibre, comprising the steps of:

providing plant fibre of differing lengths, including:

at least 20% by volume of medium length elongate plant fibre of a length of not less than 2 inches and not more than 5 inches;

not more than 10% by volume of long length elongate plant fibre of a length of greater than 5 inches;

a balance of short length plant fibre of a length of less than 2 inches; and spreading the plant fibre along an intended travel path; and compacting the plant fibre with the medium length elongate plant fibre serving to mesh together the short length plant fibre to form a cohesive ground cover mat.

2. The method as defined in claim 1, wherein the plant fibre used is wood fibre.

* * * * *